US009314123B1

(12) United States Patent
Schlang

(10) Patent No.: US 9,314,123 B1
(45) Date of Patent: Apr. 19, 2016

(54) HANGER ADAPTER

(71) Applicant: Richard Jay Schlang, Battle Ground, WA (US)

(72) Inventor: Richard Jay Schlang, Battle Ground, WA (US)

(73) Assignee: VIRTUALREP INCORPORATED, Battle Ground, WA (US)

( * ) Notice: Subject to any disclaimer, the term of this patent is extended or adjusted under 35 U.S.C. 154(b) by 0 days.

(21) Appl. No.: 14/465,066

(22) Filed: Aug. 21, 2014

(51) Int. Cl.
*A47G 25/14* (2006.01)
*A47G 25/06* (2006.01)
*A47G 25/28* (2006.01)

(52) U.S. Cl.
CPC ..... *A47G 25/1442* (2013.01); *A47G 25/06* (2013.01); *A47G 25/14* (2013.01); *A47G 25/28* (2013.01)

(58) Field of Classification Search
CPC ... A45G 25/06; A45G 25/14; A45G 25/1442; A45G 25/145; A45G 25/18; A45G 25/28; B65H 37/00; A41D 27/22; A47F 5/00
USPC ..... 223/85, 88; 211/113; D6/315, 318, 328
See application file for complete search history.

(56) References Cited

U.S. PATENT DOCUMENTS 2,498,400 A * 2/1950 Du Lude ..... 223/88
2,499,188 A * 2/1950 Freeman ..... 211/113
2,908,428 A * 10/1959 Schrunk ..... 223/88
2,998,142 A * 8/1961 Reed ..... 211/113
3,792,804 A * 2/1974 Ponzo ..... 223/85
3,961,734 A * 6/1976 Threeton, Sr. ..... 294/143
5,558,383 A * 9/1996 Lancellotti ..... 294/143
5,799,769 A 9/1998 Heer et al.
D480,293 S * 10/2003 Ismail ..... D8/372
2007/0251961 A1* 11/2007 Fryer et al. ..... 223/85

FOREIGN PATENT DOCUMENTS

GB 2064316 A * 6/1981

OTHER PUBLICATIONS

Flickr post (submitted herewith as NPL_Flickr.pdf) at https://www.flickr.com/photos/rbrome/3177558579/Post indicates picture taken on Jan. 7, 2009.

Lifehacker post (submitted herewith as NPL_lifehacker.pdf) at http://www.lifehacker.com.au/2011/05/ask-lh-how-can-i-make-anti-theft-coat-hangers-more-useful/Post indicates publication on May 23, 2011.

* cited by examiner

*Primary Examiner* — Ismael Izaguirre
(74) *Attorney, Agent, or Firm* — Underwood & Associates, LLC

(57) ABSTRACT

Anti-theft hanger adapters are disclosed. An anti-theft hanger adapter can include a main body coupled with a hook member for hanging the adapter. The main body can include at least one support, recess, member, or other structure configured to reversibly couple an anti-theft hanger to the adapter, thereby allowing the adapter and the anti-theft hanger to be hung from a select location.

13 Claims, 3 Drawing Sheets

HANGER ADAPTER

TECHNICAL FIELD

This disclosure provides systems and methods to allow a user to utilize anti-theft hangers in desired locations.

BACKGROUND

Hotels, motels, cruise ships, recreational vehicles, and other lodgings are often designed to provide many of the amenities found at home. Among those include common convenience items such as toiletries, cups, glasses, irons and hangers which, in general, patrons are free to use as they wish. However, such items are commonly removed from hotel and motels rooms, either accidentally or on purpose. This has led to the emergence of so-called "anti-theft" hotel and motel products designed to reduce the loss of those items.

Among the anti-theft products commonly found in hotels and motels are anti-theft hangers. Hangers of this sort typically include a frame, such as the common "A-frame" hanger, or a curved bar designed to hold articles of clothing. The most common type of anti-theft hanger includes a straight bar extending from the frame which lacks the curved portion found on standard hangers. The bar typically terminates with a ball or cube structure that is designed to fit into an adapter that itself is secured onto a hanger bar, e.g., within a closet. In most cases, the adapter is configured such that it is not removable by the user, which removes the freedom of choice that a user would otherwise have to hang their clothes in a chosen location.

Many travelers realize the benefits of hanging their clothes in a desired location, such as in a bathroom, as this allows clothes to be steamed to remove wrinkles Common anti-theft measures substantially preclude the user from hanging clothes in a desired location, and requires the user to supply their own hangers for such purposes which can be inconvenient. Thus, an adapter that allows anti-theft hangers to be placed in desired locations can provide benefits to travelers.

SUMMARY

In general, anti-theft hanger adapters are presented. For the purpose of this disclosure, an "anti-theft" hanger is generally one that includes measures for substantially preventing a person from hanging the hanger in a desired location such as a shower curtain rod, doorknob, towel rack, etc. Such measures can include, for example, the absence of a hanger hook, or sizing the hook with dimensions that substantially preclude a person from hanging the hanger on common objects, such as those described above. In one exemplary embodiment, an anti-theft hanger adapter is configured to adapt an anti-theft hanger so that it can be hung in a desired location.

In one exemplary embodiment, an adapter is provided. The adapter includes a main body conjoined with a support engagement member. The main body is configured to reversibly couple to a portion of an anti-theft hanger to provide the capability of hanging the anti-theft hanger in a desired location. In one embodiment, the support engagement member is a hook. In one embodiment, the support engagement member is rotatable relative to the main body.

In one embodiment, the main body includes a plurality of adjacent wall members configured to define a recess for reversibly receiving a terminal end portion of a ball-and-post member of the anti-theft hanger. In a related embodiment, the recess is substantially Y-shaped. In a related embodiment, a top portion of the Y-shaped recess is configured to receive the ball of the ball-and-post member, and a bottom portion of the Y-shaped recess is configured to receive the post of the ball-and-post member. In yet another related embodiment, the recess has a cross-sectional width slightly less than the cross-sectional width of the ball-and-post member to provide frictional engagement between the Y-shaped recess and the ball-and-post member. In a further related embodiment, the Y-shaped recess includes at least two tapered wall portions configured to confront the ball of the ball-and-post member when the anti-theft hanger is coupled with the main body.

In one embodiment, the main body includes a protrusive hook support member configured to provide the capability of hanging a miniature hook of an anti-theft hanger therefrom. In a related embodiment, the protrusive hook support member includes an arcuate platform protruding from a front face of the main body. In a related embodiment, the protrusive hook support member further includes a platform wall member substantially orthogonally adjacent to the arcuate platform for reducing the likelihood of unintentional disengagement between the protrusive hook support member and the anti-theft hanger.

In one embodiment, the main body is configured to couple to a plurality of different anti-theft hanger types. In a related embodiment, a first anti-theft hanger type is a ball-and-post hanger, and a second anti-theft hanger type is a miniature-hook hanger. In a related embodiment, the main body includes a Y-shaped recess for reversibly coupling to the ball-and-post-type anti-theft hanger subjacent to a protrusive hook support member configured for hanging a miniature-hook-type anti-theft hanger therefrom. In yet another related embodiment, the main body is configured to reversibly couple to another of the adapters in a tandem configuration.

In one exemplary embodiment, an adapter configured to provide the capability of hanging an anti-theft-type hanger in a desired location is provided. The adapter includes a main body conjoined with a support engagement member, and means for coupling a portion of the anti-theft hanger with the main body so as to provide the capability of hanging the adapter coupled with the anti-theft hanger in a desired location.

In one exemplary embodiment, an anti-theft clothes hanger adapter is provided. The adapter includes a hook member integral with a main body. The main body includes front and back sides with a main body thickness therebetween, a Y-shaped cavity disposed between the front and back sides configured to support a ball-and-post member of an anti-theft hanger in a hanging configuration, and a protruding hook support member configured to support a miniature hook member of a second type of anti-theft hanger therefrom.

In one embodiment, the protruding hook support member is an arcuate support member protruding from the front of the adapter.

In one embodiment, the adapter further includes a wall member orthogonally-oriented, and adjacently disposed to the protruding hook support for reducing the likelihood of disengaging the miniature hook member from the hook support member.

In one embodiment, the main body includes a hollow portion for receiving the protruding hook support member such that a plurality of the adapters can be reversibly coupled in a tandem configuration.

The systems, articles, and methods described herein provide certain distinct advantages. For example, travelers can utilize anti-theft hangers in ways that would otherwise be precluded due to the nature of many anti-theft designs, including the ability to hang garments in bathrooms for steaming purposes, among others.

Unless otherwise defined, all technical and scientific terms used herein have the same meaning as commonly understood by one of ordinary skill in the art. Although methods and materials similar or equivalent to those described herein can be used in the practice or testing of any described embodiment, suitable methods and materials are described below. In addition, the materials, methods, and examples are illustrative only and not intended to be limiting. In case of conflict with terms used in the art, the present specification, including definitions, will control.

The foregoing summary is illustrative only and is not intended to be in any way limiting. In addition to the illustrative aspects, embodiments, and features described above, further aspects, embodiments, and features will become apparent by reference to the drawings and the following detailed description and claims.

DESCRIPTION OF DRAWINGS

The present embodiments are illustrated by way of the figures of the accompanying drawings, which may not necessarily be to scale, in which like references indicate similar elements, and in which.

DETAILED DESCRIPTION OF ILLUSTRATIVE EMBODIMENTS

In one exemplary aspect, a hanger adapter is provided. In various embodiments thereof, the hanger adapter includes a main body conjoined with a support engagement member such as a hook, which is configured to allow the hanger adapter to be hung on an object of choice, e.g., a shower curtain rod, door hook, etc. The main body includes at least one coupling mechanism, member, recess, or other structure configured to receive a hanging-support portion of at least one type of a so-called "anti-theft" hanger. For example, in one embodiment, the main body can be configured to receive a hanging-support portion of a first type of anti-theft hanger; in another embodiment, the main body can be configured to receive a hanging-support portion of a first type of anti-theft hanger, and additionally configured to receive a hanging-support portion of a second type of anti-theft hanger. In general, hanger adapters as disclosed herein can provide the capability of hanging clothes in a desired location which would otherwise be difficult or impossible due to the inherent nature and design of many anti-theft hangers.

Figure 1:
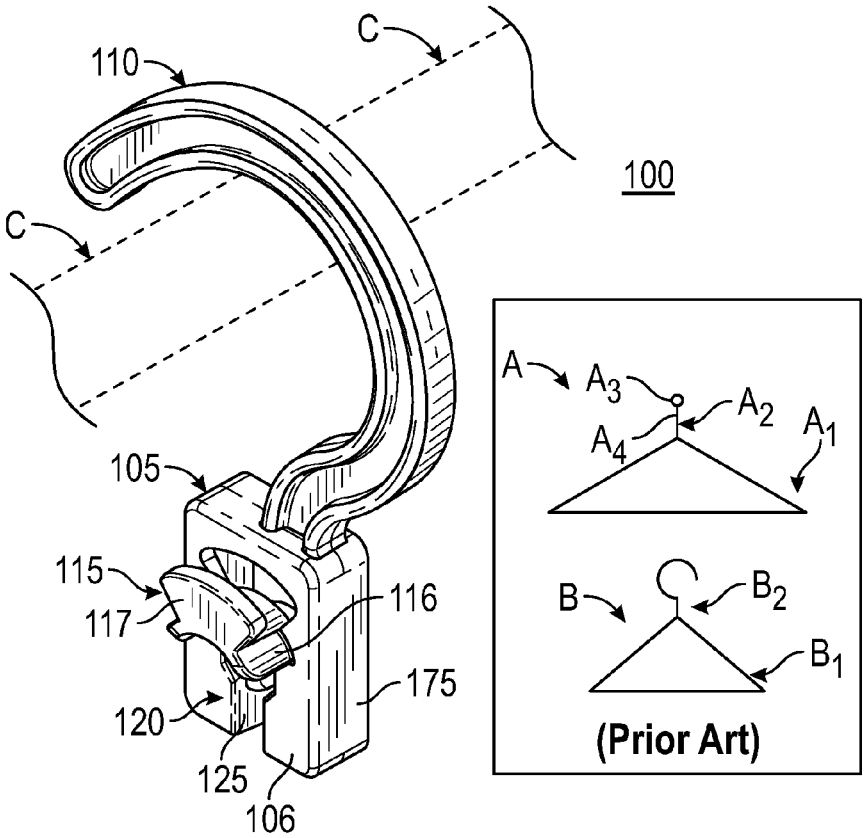
FIG. 1 illustrates an isometric view of a hanger adapter 100 according to one embodiment, and also shows an inset of prior-art hanger types.

FIGS. 1-5 illustrate a hanger adapter 100 (hereinafter "adapter") according to one embodiment. Referring first to FIG. 1, in this embodiment, the adapter 100 includes a main body 105 conjoined with a support engagement member which, in this example is a substantially C-shaped hook member 110. In general, the support engagement member can be a hook, bracket, loop, or other structure that provides the capability of hanging the adapter on various supports such as shower curtain rods, towel hangers, doorknobs, etc. In this embodiment, the hook member 110 is configured to allow the adapter 100 to be hung on various supports, e.g., shower curtain rod C (as illustrated by the dashed bar in FIG. 1), towel hooks, door knobs, etc. In this embodiment, the main body 105 is integral with the hook member 110 as illustrated. In other, alternative embodiments, however, the main body 105 of the adapter 100 can be configured such that the main body 105 can be reversibly coupled with a variety of different hook member attachments, each of which can be of a different design or serve a different function. For example, a first hook member can be configured for hanging the adapter 100 from a shower curtain rod having a diameter of one inch; a second type of hook member can be configured for hanging the adapter from a towel rack having a square rod with a cross-section width of two inches.

Although not illustrated in FIGS. 1-5, in one embodiment, the hook member 110 can be pivotally coupled to the main body 105 to allow the hook member 110 to be rotated into a desired configuration for hanging the adapter 100 on a door or other flat object.

Figure 2:
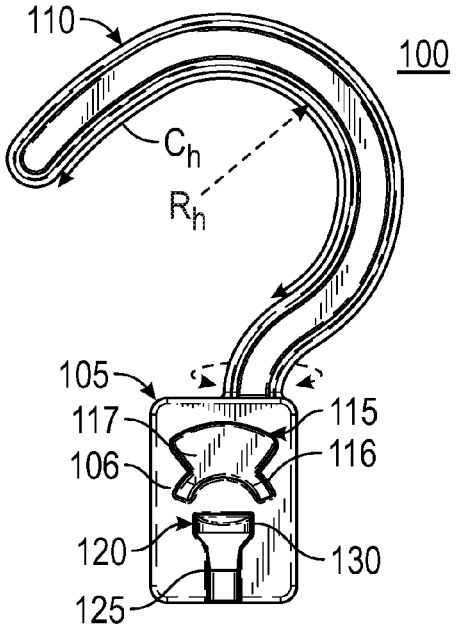
FIG. 2 is a front-elevation view of the hanger adapter 100 of FIG. 1 according to one embodiment.
Figure 3:
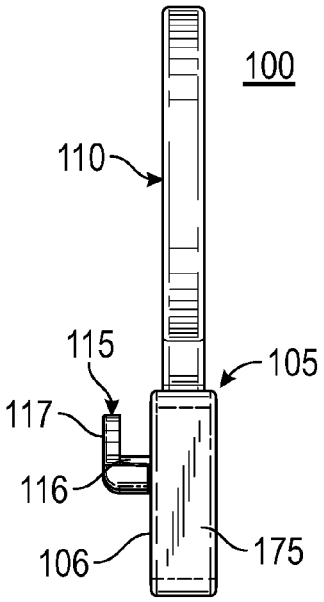
FIG. 3 is a side-elevation view of the hanger adapter 100 of FIG. 1 according to one embodiment.

In this embodiment, the main body 105 is configured to receive a hanging-support portion of at least two anti-theft hanger types. Referring to the inset labeled "Prior Art" in FIG. 1, the first type of anti-theft hanger is a so-called ball-and-post hanger A, which includes a main hanger body $A_1$ and a hanging-support member, ball-and-post member $A_2$, extending therefrom, as illustrated. Referring in particular to FIG. 2, in this embodiment, the adapter 100 includes a substantially Y-shaped recess 120 defined by channel 125 and tapered upper channel portion 130. It should be understood that the configuration of the Y-shaped recess 120 as shown in FIGS. 1-5 is one of many available options which can be modified to accommodate various shapes and sizes of anti-theft ball-and-post hanger types.

In this embodiment, the Y-shaped recess 120 is configured to allow insertion of a portion of the ball-and-post member $A_2$ therein. For example, in this embodiment, the upper channel portion 130 is configured to receive the ball portion $A_3$, and channel 125 is configured to receive the post portion $A_4$. During use, e.g., when the ball-and-post member $A_2$ is inserted into the Y-shaped recess 120, gravity urges the ball portion against the tapered portion juxtaposed between the channel portion 125 and the tapered upper channel portion 130 to reduce the likelihood of the hanger A disengaging from the adapter 100.

In one embodiment, the cross-sectional width of the face of channel 125 and the upper tapered channel portion 130 can be slightly less than the cross-sectional width of the ball-and-post member A2 of an anti-theft hanger, respectively, such that an urging force is required to insert the ball-and-post member A2 into the Y-shaped recess 120. In practice, a user can "snap" the ball-and-post member $A_2$ into the Y-shaped recess 120, which can reduce the likelihood of accidental disengagement therebetween.

In another embodiment, the tapered upper channel portion 130 can include a substantially fitted recess (not illustrated in FIGS. 1-5), e.g., in the tapered portion between the channel 125 and the tapered upper channel portion 130, such that the ball portion $A_3$ of a ball-and-post member $A_2$ is seated therein to reduce the likelihood of shifting within the Y-shaped recess 120.

Figure 6:
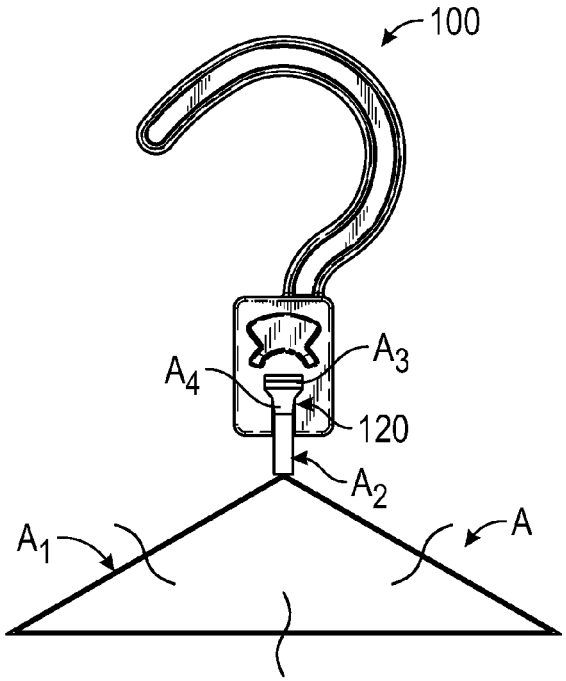
FIG. 6 illustrates the hanger adapter 100 engaged with a first type of a prior-art anti-theft hanger, according to one embodiment.

Referring briefly to FIG. 6, the adapter 100 is shown in a coupled configuration with a portion, e.g., the ball-and-post portion $A_2$ of anti-theft hanger A. FIG. 6 illustrates, in one embodiment, the functionality of the adapter 100 in providing the ability to hang the anti-theft hanger A in a desired location when coupled with the adapter 100 as shown.

In this embodiment, the Y-shaped recess provides for coupling a portion of an anti-theft hanger, e.g., a ball-and-post portion of an anti-theft hanger, with the main body so as to provide the capability of hanging the adapter coupled with the anti-theft hanger in a desired location.

Referring back to FIGS. 1-5, in this embodiment, the adapter 100 is capable of engaging a second type of prior-art anti-theft hanger, hanger B. Prior art hanger B is one that is generally designed with a different type of hanging-support, which includes "miniature" hook portion $B_2$. Anti-theft hangers employing the miniature-hook structure are generally designed to thwart patrons from stealing the hangers because they are too small to fit on a standard closet hanger bar. Instead, these types of hangers are generally provided by hotels and motels for hanging on wire shelving having relatively thin support bars.

Figure 7:
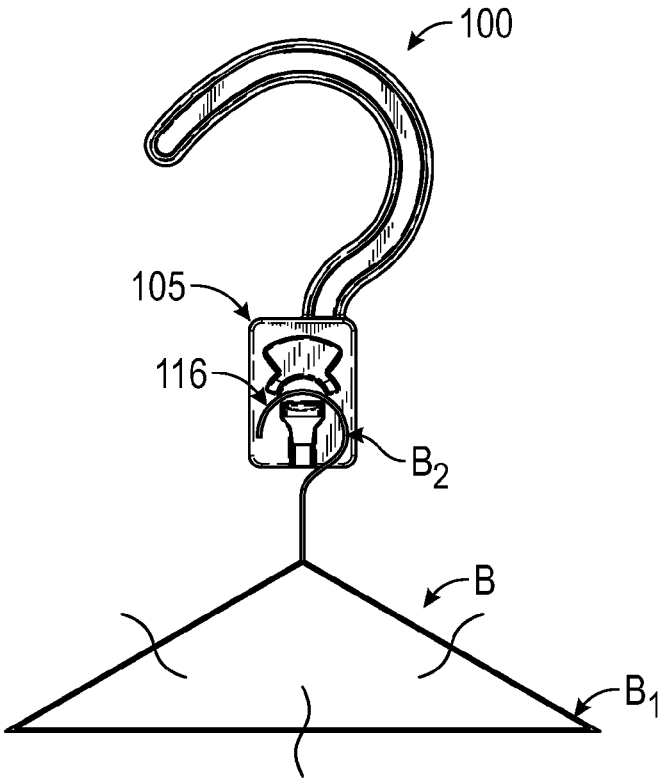
FIG. 7 illustrates the hanger adapter 100 engaged with a second type of a prior-art anti-theft hanger, according to one embodiment.

In this embodiment, the main body 105 includes a hook support member 115 that protrudes from the main body front face 106. In this embodiment, the hook support member 115 includes an arcuate platform 116 extending substantially perpendicularly from the main body front face 106 as illustrated and is configured to receive the hook portion $B_2$ of a hanger B in a hanging orientation as shown, e.g., in FIG. 7. A platform wall member 117 extends perpendicularly from the arcuate platform 116 as illustrated and serves to reduce the likelihood of the hook portion B2 from unintentionally slipping off of the arcuate platform 116.

In this embodiment, the hook member 110 can have a shape and size that is similar to standard hangers so that the adapter can be hung on a variety of objects, e.g., shower curtain rods, doorknobs, coat hooks, etc. It should be understood that the size and shape of the hook support member 115 can be chosen to accommodate any desired size of a hook portion $B_2$ of anti-theft hanger B, or other types of anti-theft hangers. For example, hook support member 115 can also support anti-theft hangers which include a ring instead of a hook for hanging the hanger.

In this embodiment, the hook support member provides for coupling a portion of an anti-theft hanger, e.g., a miniature-hook portion of an anti-theft hanger, with the main body so as to provide the capability of hanging the adapter coupled with the anti-theft hanger in a desired location.

Figure 4:
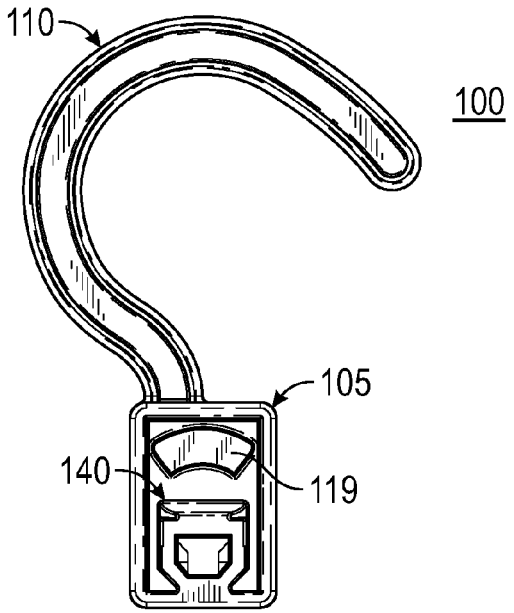
FIG. 4 is a rear-elevation view of the hanger adapter 100 of FIG. 1 according to one embodiment.
Figure 5:
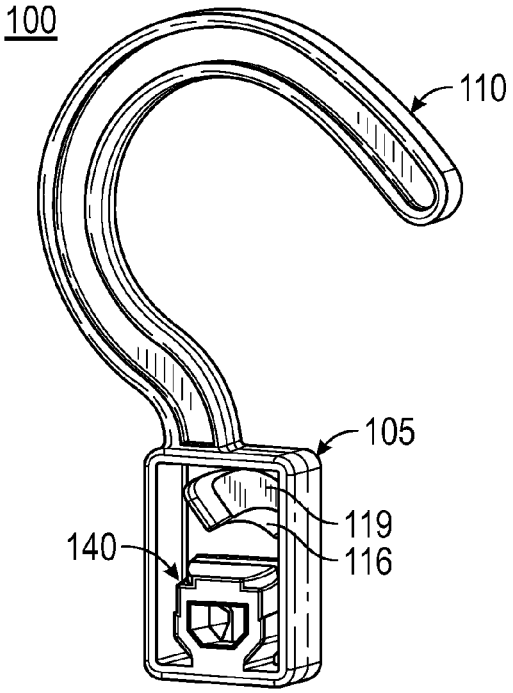
FIG. 5 is a rear isometric view of the hanger adapter 100 of FIG. 1 according to one embodiment.

Referring now to FIGS. 4 and 5, a rear-elevational view, and a rear isometric view of the adapter 100 are shown, respectively. In this embodiment, the main body 105 is substantially hollow, except for jacket 140 in which the Y-shaped recess 120 is disposed. A rear face 119 of platform wall member 117 is visible in the views of FIGS. 4 and 5.

Figure 8:
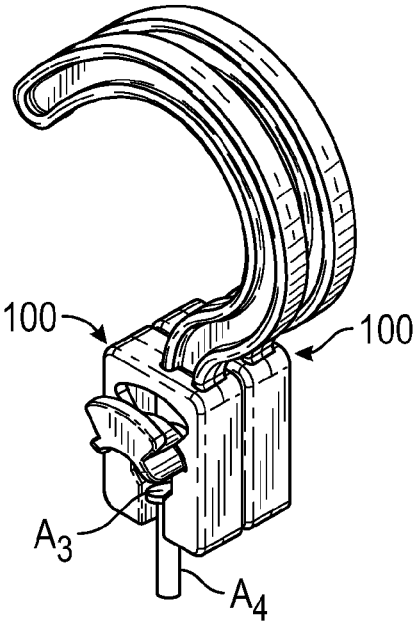
FIG. 8 illustrates two hanger adapters reversibly coupled in a tandem configuration.

Referring now to FIG. 8, in this embodiment, the hollow configuration of the main body 105 provides the ability to stack multiple adapters in a confronting, space-saving configuration as illustrated. Such functionality can allow a user to transport more than one adapter 100 in a compact configuration which can be useful, e.g., when traveling.

In general, adapters of the type described herein can be formed of any chosen material; however, certain types of plastic can be lightweight for travel while providing strength and durability for supporting the weight of hangers and clothing items. Adapters of the type described herein can be advantageously made from plastic to reduce the likelihood of commercial airline security concerns when placed in carry-on luggage. One exemplary plastic for such a purpose is formed from acrylonitrile-butadiene-styrene polymers such as those sold under the LUSTRAN® ABS trade name. In general, the hook member 110 can be configured for hanging the adapter from a chosen type of support; for example, the semi-circumference $C_h$, radius $R_h$ (FIG. 2), and the overall shape of the hook itself can be chosen according to the type of support the adapter is targeted for. For example, without limitation, the radius of the hook member 110 as illustrated in FIG. 2 can be 0.5, 0.75, 1.0, 1.5, or 2.0 inches.

In general, an adapter of the type described herein can be formed by any desired manufacturing process including, e.g., plastic injection molding.

A number of illustrative embodiments have been described. Nevertheless, it will be understood that various modifications may be made without departing from the spirit and scope of the various embodiments presented herein. For example, in one embodiment, the main body 105 can include a plurality of hook support members. In such an embodiment, a first hook support member 115 can be disposed on the main body front face 106, e.g., as illustrated in FIGS. 1-5. A second hook support member (not illustrated in FIGS. 1-5) can be disposed on a side wall orthogonal to the main body front face 106, e.g., side wall 175. Such a configuration can provide the capability of hanging an anti-theft hanger from the adapter in an orientation that is perpendicular to the hook member, e.g., hook member 110. This allows a user to hang the adapter on a flat surface, e.g., the top portion of a door, orienting the anti-theft hanger perpendicular to the hook member and parallel to the flat surface. In one embodiment, the main body 105 can further include hooks, posts, or other structures for hanging items such as towels, washcloths, clothes or other items, in addition to the aforementioned structures for coupling an anti-theft hanger thereto as described herein. Accordingly, other embodiments are within the scope of the following claims.

What is claimed is:

1. An adapter, comprising:

a main body conjoined with an open-hook support engagement member;

wherein said main body comprises a laterally-protruding shelf member for receiving a miniature hook or ring portion of a first type of anti-theft hanger, and a substantially Y-shaped recess subjacently disposed to said laterally-protruding shelf member for reversibly receiving a ball-and-post portion of a second, different type of anti-theft hanger.

2. The adapter of claim 1, wherein said support engagement member is rotatable relative to said main body.

3. The adapter of claim 1, wherein said Y-shaped recess has a cross-sectional width slightly less than the cross-sectional width of said ball-and-post member to provide frictional engagement between said Y-shaped recess and said ball-and-post member.

4. The adapter of claim 1, wherein said Y-shaped recess includes at least two tapered wall portions configured to frictionally engage the ball of said ball-and-post portion when received within said Y-shaped recess.

5. The adapter of claim 1, wherein said laterally-protruding shelf member comprises an arcuate platform having a radius of curvature that substantially matches the radius of curvature of said miniature hook or said ring portion of said first type of anti-theft hanger protruding from a front face of said main body.

6. The adapter of claim 5, wherein said laterally-protruding shelf member further comprises an orthogonally-disposed platform wall member configured to reduce the likelihood of unintentional disengagement between said laterally-protruding shelf member and said first type of anti-theft hanger.

7. The adapter of claim 1, wherein said main body is configured to concurrently support said first and said second anti-theft hanger type.

8. The adapter of claim 7, wherein said main body comprises a recess adjacent to said laterally-protruding shelf member that is configured to receive a laterally-protruding shelf member of another of said adapters, to provide the capability of coupling a plurality of said adapters in a stacked configuration such that the main body and the engagement member of a first adapter confronts the main body and engagement member respectively of a second adapter of said plurality of said adapters.

9. An anti-theft hanger adapter, comprising:

a main body conjoined with a support engagement member; and means for concurrently supporting a ball-and-post portion of a first type of anti-theft hanger and a hook or loop portion of a second anti-theft hanger type from said main body.

10. An anti-theft clothes hanger adapter, comprising:

a hook member integral with a main body, the main body comprising front and back sides with a main body thickness therebetween, a Y-shaped cavity disposed between said front and back sides configured to support a ball-and-post member of an anti-theft hanger in a hanging configuration, and a protruding hook support member configured to support a miniature hook member of a second type of anti-theft hanger therefrom.

11. The anti-theft clothes hanger adapter of claim 10, wherein said protruding hook support member is an arcuate support member protruding from said front side of said adapter.

12. The anti-theft clothes hanger adapter of claim 10, further comprising a wall member orthogonally-oriented, and adjacently disposed to said protruding hook support for reducing the likelihood of disengaging said miniature hook member from said hook support member.

13. The anti-theft clothes hanger adapter of claim 10, wherein said main body comprises a hollow portion for receiving said protruding hook support member such that a plurality of said adapters can be reversibly coupled in a tandem configuration.

* * * * *